US007037036B2

(12) United States Patent
Strassman

(10) Patent No.: US 7,037,036 B2
(45) Date of Patent: May 2, 2006

(54) ASPHALT SEAM HEATER

(76) Inventor: David R. Strassman, 2534 S. Fish Hatchery Rd., Madison, WI (US) 53711

( * ) Notice: Subject to any disclaimer, the term of this patent is extended or adjusted under 35 U.S.C. 154(b) by 116 days.

(21) Appl. No.: 10/800,932

(22) Filed: Mar. 15, 2004

(65) Prior Publication Data

US 2005/0002736 A1 Jan. 6, 2005

Related U.S. Application Data

(60) Provisional application No. 60/455,023, filed on Mar. 14, 2003.

(51) Int. Cl.
*E01C 23/14* (2006.01)

(52) U.S. Cl. ..... 404/95

(58) Field of Classification Search ..... 404/77, 404/79, 95; 280/491.1, 491.3, 491
See application file for complete search history.

(56) References Cited

U.S. PATENT DOCUMENTS 2,471,462 A * 5/1949 Toth ..... 280/653
3,407,836 A * 10/1968 Keiser ..... 137/899.3
3,852,025 A 12/1974 Placek
4,749,303 A * 6/1988 Keizer et al. ..... 404/86
4,946,384 A 8/1990 London
5,114,284 A 5/1992 Keizer et al.
5,188,481 A 2/1993 O'Brien
5,218,952 A 6/1993 Neufeldt
5,653,552 A 8/1997 Wiley et al.
6,669,467 B1 * 12/2003 Kieswetter ..... 431/154

* cited by examiner

*Primary Examiner*—Raymond W Addie
(74) *Attorney, Agent, or Firm*—Joseph T. Leone, Esq.; DeWitt Ross & Stevends S.C.

(57) ABSTRACT

An articulated frame movable between a collapsed position and an extended position. A main wheel assembly is attached to the frame and movable between a support position where the main wheel assembly supports the frame and enables the asphalt seam heater to be towed behind a towing vehicle when the articulated frame is in the collapsed position, and a retracted position wherein the main wheel assembly does not support the frame. At least one asphalt heater of a defined configuration is disposed within and supported by the frame. Each heater includes a housing having an upper chamber and a lower chamber; a gas-permeable refractory material disposed in the housing to define a closed upper chamber and an open-ended lower chamber; a fuel line for introducing a combustible fuel-air mixture in to the upper chamber; a venturi disposed between the fuel line and the upper chamber; and an igniter disposed in the lower chamber, wherein fuel introduced into the upper chamber diffuses through the gas-permeable refractory material and into the lower chamber, where it is ignited by the igniter.

14 Claims, 6 Drawing Sheets

15
15
19
21
21
19
11
19
21
19
21
11
13
17
13
50
50
50
50
50
50

ASPHALT SEAM HEATER

CROSS-REFERENCE TO RELATED APPLICATIONS

Priority is hereby claimed to provisional application Ser. No. 60/455,023, filed Mar. 14, 2003, which is incorporated herein.

FIELD OF THE INVENTION

The invention is directed to an asphalt seam heater for creating and sealing a permanent seam between two runs of asphalt. The invention is collapsible and can be towed behind a towing vehicle. The invention is particularly well suited to fabricating asphalt road ways, automotive racing speedways, driveways, parking lots, and the like.

BACKGROUND

The prior art describes various processes for heating asphalt surfaces. A process for continuously heating an asphalt surface is described in Wiley et al., U.S. Pat. No. 5,653,552. The process involves moving at least two independent heaters arranged in a series back and forth along the asphalt surface until the asphalt is heated to the desired temperature. In addition, the process may involve rupturing the heated asphalt to establish a ruptured upper surface. After moisture is eliminated through mixing of the ruptured upper surface, the surface is pressed to provide a recycled asphalt surface.

U.S. Pat. No. 5,218,952 to Neufeldt describes a radiant heating apparatus used to heat a large surface area of asphalt to a desired temperature. The heating apparatus uses a pressurized gaseous fuel, such as propane, to generate heat and has an open bottom, covered with a layer of ceramic fiber between two layers of mesh and an upper chamber.

O'Brien, U.S. Pat. No. 5,188,481, discloses an asphalt heating unit which heats already existing asphalt surfaces. The heating unit rests on a movable frame which allows rotation of the heating unit to several positions. One embodiment of the invention substitutes a trailer for the movable frame. In addition, the heating unit may use various forms of heating sources in its heating chamber, such as an infrared heater.

U.S. Pat. No. 5,114,284 to Keizer et al. is a continuation of U.S. Pat. No. 4,749,303 to Keizer et al. The applications disclose a hinged asphalt heater. The heater has two heating sections with a hinge in the middle. Both sections contain wheels to allow the sections to be moved along the surface to be heated. The outer casing of the first section contains a removable fuel tank and the outer casing of the second section contains a set a trailer tires and a trailer tongue. The hinge allows the sections to be folded together so that the wheels of the second section are touching the ground and the trailer tongue can be attached to a vehicle for the easy movement of the heater. Each section has a mixing channel which receives a combustible fuel mixture for heating the section.

A gas pilot igniter for igniting combustible gases and burning fuel/air mixtures is described in London, U.S. Pat. No. 4,946,384. One advantage of the igniter is its ability to allow the use of fuels with variable combustion points. Here, the igniter includes a fuel gas inlet means, a primary mixing chamber, a main combustion chamber, a pre-combustion chamber and a baffle plate.

U.S. Pat. No. 3,852,025 to Placek discloses an infra-red heater. The heater is gas-fired and has a cup shaped body, an open front end and a mixing area for the combustible air mixture. A combustion screen is used to prevent flashbacks which are common in gas-fired radiant heat generators. In addition, the heater is particularly useful in the removal of paint, the softening of adhesives and the softening of flooring surfaces.

A particular difficulty is encountered when fabricating highways and other public thoroughfares. A standard two-lane highway is generally twice as wide as the width of a conventional, large-scale asphalt paving machine. Thus, asphalt roadways are conventionally made in lengthwise sections. One lane is fabricated first, and then the second lane (and any subsequent lanes) are fabricated afterward. To fabricate the second and subsequent lanes, a seam is formed between the cooled first lane of asphalt, and the hot asphalt of the second lane that is being disposed onto the road bed. This yields a finished roadway having one or more longitudinal seams that extend the length of the roadway.

This type of asphalt road construction yields one distinct advantage and one distinct disadvantage. The advantage is that the seam is normally (and purposefully) situated in the middle of the roadway, and is thus covered by the painted yellow line that separates the on-coming lanes of traffic. In multi-lane roadways, the seams are purposefully disposed between two lanes of traffic moving in the same direction, and are thus covered by the painted white lines that define the various lanes of traffic. In both instances, cars traveling on the roadway cross a seam only when changing lanes or turning. Each finished lane of the roadway is very smooth, essentially seamless, and yields a quiet, comfortable automobile ride.

The disadvantage is that the seam is a weak point in the road construction. Because the first-formed lane of asphalt is cold, and the second lane being formed is piping hot, the hot asphalt does not interpenetrate the cold asphalt. In essence, then, the two lanes of asphalt simply abut one another. In the trade, this type of seam is often referred to as a "cold joint." When the asphalt is newly set, the lanes abut one another quite tightly. But over time, the seam begins to spread. This allows water to enter the seam. Through freeze-thaw cycling of the water trapped in the seam, the asphalt then begins to crumble at the seams. The problem is especially pronounced at far northern and far southern latitudes, where the summer temperatures soar, and the winter temperatures plummet.

The conventional treatment is to pour hot rubber into the parted seam to exclude the entry of still more water into the seam. This treatment, however, is a temporary expedient. Because the rubber does not expand and contract at the same rate as the asphalt, the treatment must be repeated essentially every spring in order to be effective. The need for continuous repair of the seams snarls traffic and increases the work of already over-extended municipal road crews. Thus, while the overall construction approach yields a quiet roadway, degradation of the roadway begins at the seams (which are located in the center of the roadway) and works its way out.

There is thus a long-felt and unmet need for an apparatus that yields strong and permanent seams in asphalt roadways.

SUMMARY OF THE INVENTION

The invention is directed to an asphalt seam heater. The seam heater includes a frame that supports one or more asphalt heaters. The seam heater is dimensioned and configured to eliminate "cold joints" by heating a run of pre-existing, cold asphalt prior to the pre-existing asphalt being joined to a run of newly-disposed asphalt. By gently heating the pre-existing asphalt prior to forming the seam, the resulting seam is formed between two runs of pliable, hot asphalt. This results in extraordinarily tight seam that resists separation and degradation.

The seam heater of the present invention efficiently heats pre-existing, cold asphalt through its entire depth without burning the asphalt. It operates a low pressures, thus conserving fuel. It maintains the seam temperature at a desired temperature (e.g., 250° F.) at paving speeds of at least 50 feet per minute.

Thus, in a first (and preferred embodiment), the invention is n asphalt seam heater comprising an articulated frame movable between a collapsed position and an extended position. Attached to the frame is a main wheel assembly. The main wheel assembly is movable between a support position wherein the main wheel assembly supports the frame and enables the asphalt seam heater to be towed behind a towing vehicle when the articulated frame is in the collapsed position, and a retracted position wherein the main wheel assembly does not support the frame. At least one asphalt heater is disposed within and supported by the frame. Each heater comprises a housing having an upper chamber and a lower chamber. A gas-permeable refractory material is disposed in the housing to define a closed upper chamber and an open-ended lower chamber. The heater further comprises a fuel line for introducing a combustible fuel-air mixture in to the upper chamber and a venturi disposed between the fuel line and the upper chamber. These serve to introduce a combustible fuel-air misture into the upper chamber of the housing. Lastly, the heater includes an igniter disposed in the lower chamber. In this fashion, the fuel introduced into the upper chamber diffuses through the gas-permeable refractory material and into the lower chamber, where it is ignited by the igniter.

In a second embodiment of the invention, the articulated frame comprises two sub-frames. Each sub-frame is a mirror image of the other and comprises a first end and a second end. The two sub-frames are pivotally connected at their respective first ends (by one or more hinges or other suitable pivotal joint). The two sub-frames pivot about the hinge to move from the collapsed position to the extended position. A main wheel assembly is attached to each sub-frame at a point proximate to the first end of each sub-frame. As before, each main wheel assembly is movable between a support position wherein the main wheel assembly supports its respective sub-frame and enables the asphalt seam heater to be towed behind a towing vehicle when the articulated frame is in the collapsed position, and a retracted position wherein the main wheel assembly does not support its respective sub-frame. At least one asphalt heater, as described previously, is disposed within and supported by one of the sub-frames.

A third embodiment of the invention is similar to the second embodiment, but further comprises a guide wheel assembly attached to each sub-frame at a point proximate to the second end of each sub-frame. Each guide wheel assembly is movable between a retracted position wherein the guide wheel assembly does not support its respective sub-frame, and an extended position wherein the guide wheel assembly supports its respective sub-frame.

In operation, the asphalt seam heater is transported to a work location by folding it into its contracted position, and extending the main wheel assembly (or assemblies) into the support position so that it contacts the ground and supports the frame. The guide wheel assemblies, if present, are put into the retracted position. The seam heater is then attached to a towing vehicle (via a trailer tongue or other suitable fastener) and towed to the work location. Once on location, the seam heater is unfolded into its extended position, the main wheel assembly is retracted, and the guide wheels (if present) are extended. The heater is then used to heat the cold asphalt that is to be joined to a new run of asphalt.

When in the extended position, the heater can be mounted directly to an asphalt paver, or to a truck or other motorized vehicle that proceeds in advance of the paver, or the seam heater can even be advanced manually. It is preferred that the seam heater be mounted to the side of a paver so that it advances at exactly the same speed as the paver, with the guide wheels supporting the seam heater and maintaining it the proper distance from the asphalt surface to be heated.

DETAILED DESCRIPTION

Figure 1:
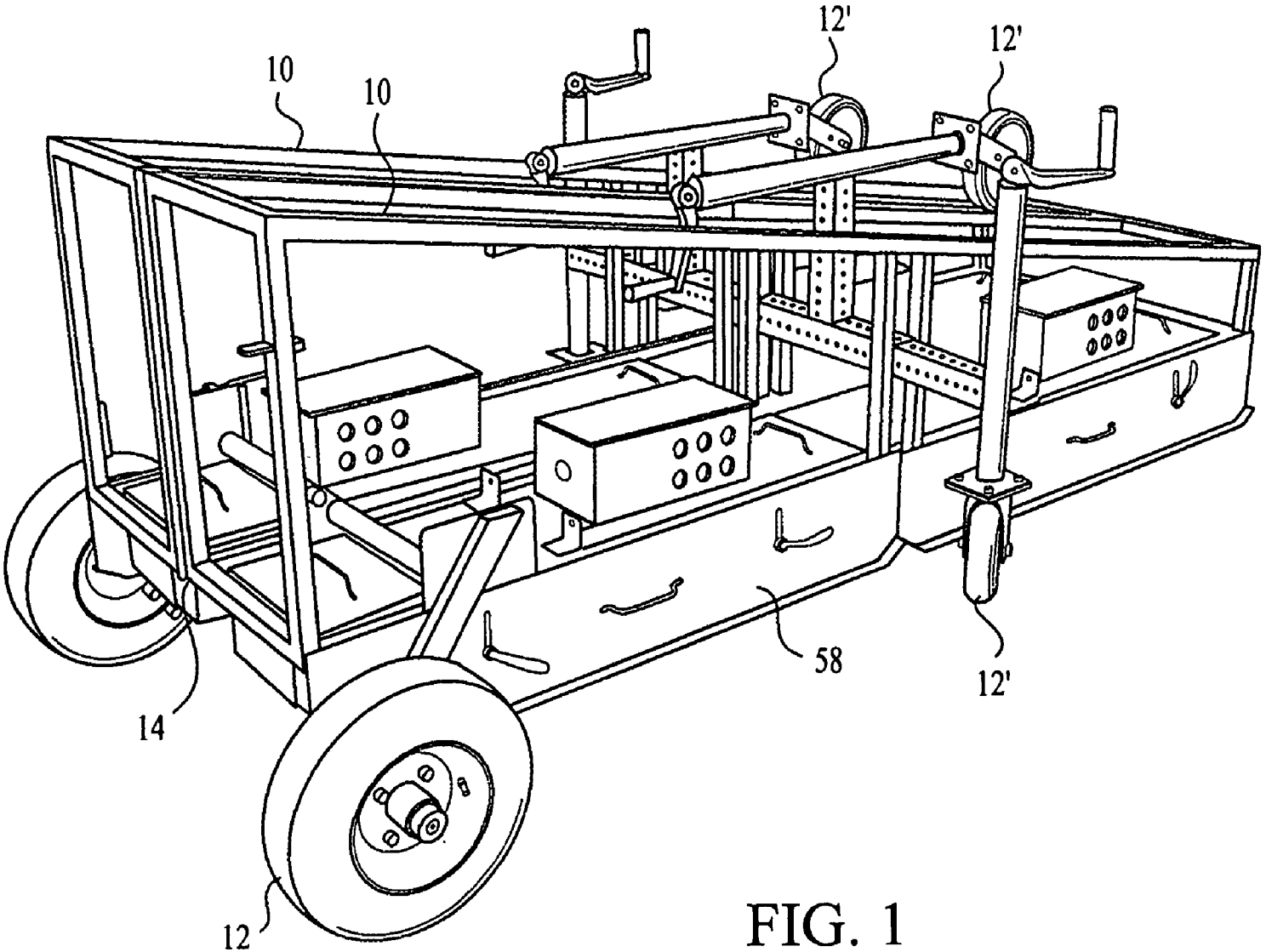
FIG. 1 is a perspective rendering of the preferred embodiment of the seam heater according to the present invention; the heater is in the collapsed position.

The invention is a collapsible asphalt seam heater. The seam heater includes a collapsible frame 10. The frame 10 includes hinges 14 that permit the frame to fold upon itself for transport, as shown in FIG. 1. As shown in FIG. 1 (which is the preferred embodiment), the frame hinges directly in the middle, each half of the frame roughly defining the shape of a trapezoid. Each half of the frame 10 is dimensioned and configured to hold therein, either realeasibly or permanently, an asphalt heater (the housing of which is designated 58). See FIGS. 4–6 and below for a further description of the heater.

The frame further includes main wheel assemblies 12 and guide wheel assemblies 12'. As shown in FIG. 1, when the seam heater is in the collapsed position, the main wheel assembly is rotated into position to support the frame off the ground. At the opposite end of the collapsed configuration, the frame includes means for towing the seam heater, such as a ball hitch (hidden from view in FIG. 1). The main wheel assemblies are rotatable such that they can be swung out of the way when the two halves of the frame are rotated away from each other to arrive at the extended position (shown in FIG. 2).

Figure 2:
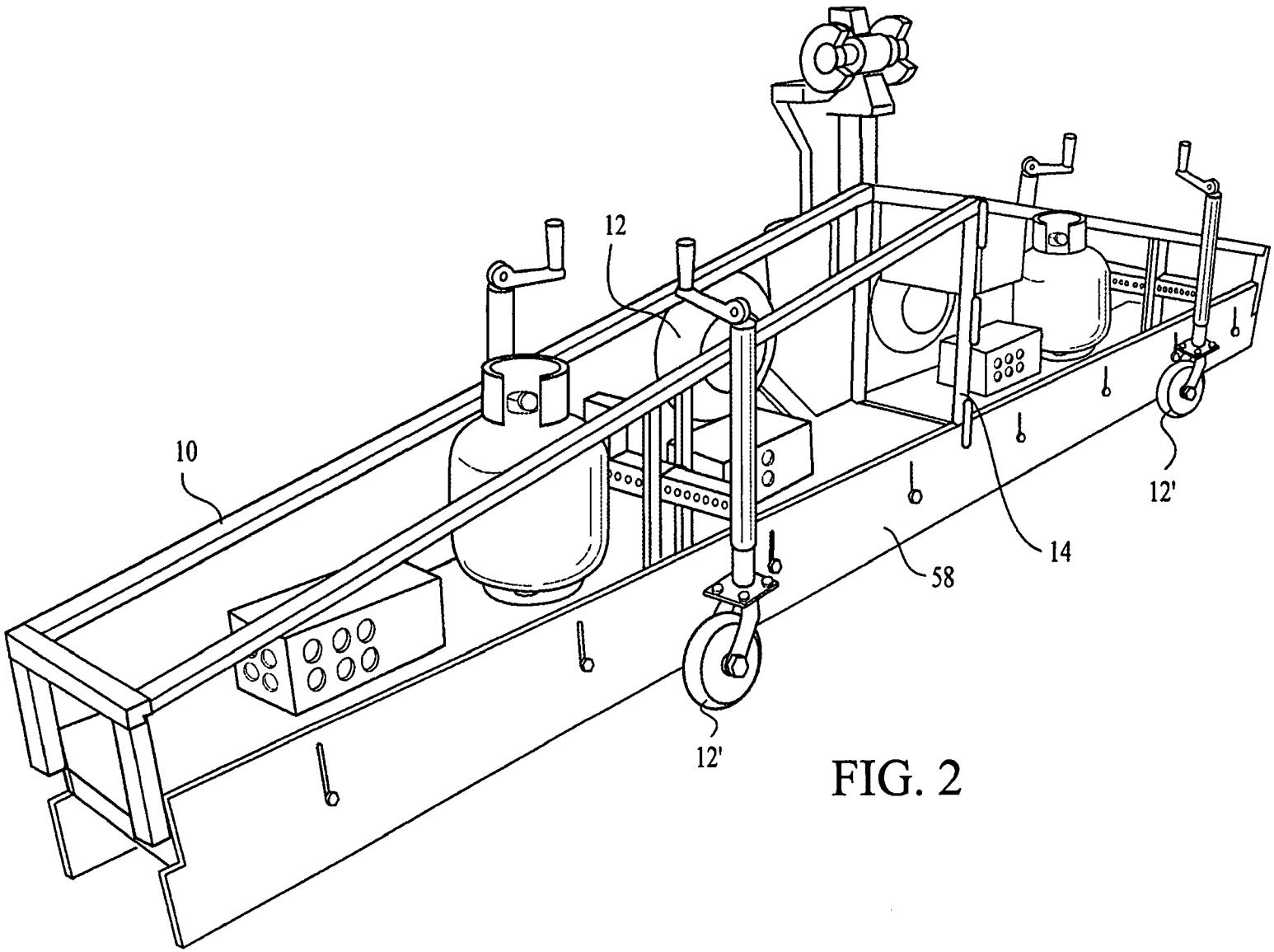
FIG. 2 is a perspective rendering of the seam heater shown in FIG. 1; the heater is in the extended position.

As shown in FIG. 2, when the two halves of the frame (i.e., the sub-frames) are swung away from each other, around the axis defined by hinges 14, the entire frame then defines a roughly pyramidal shape. The main wheel assemblies 12 are rotated away from each other such that the two sub-frames can be releasibly fastened, one to the other, along the first end of each sub-frame (proximate to the main wheel assembly). The guide wheel assemblies 12' are movable between a first retracted position (shown in FIG. 1) and a second extended position (shown in FIG. 2). The guide wheels serve to guide the seam heater as it is propelled by a suitable vehicle, such as a truck, tractor, or asphalt paver.

Figures 3A, 3B:
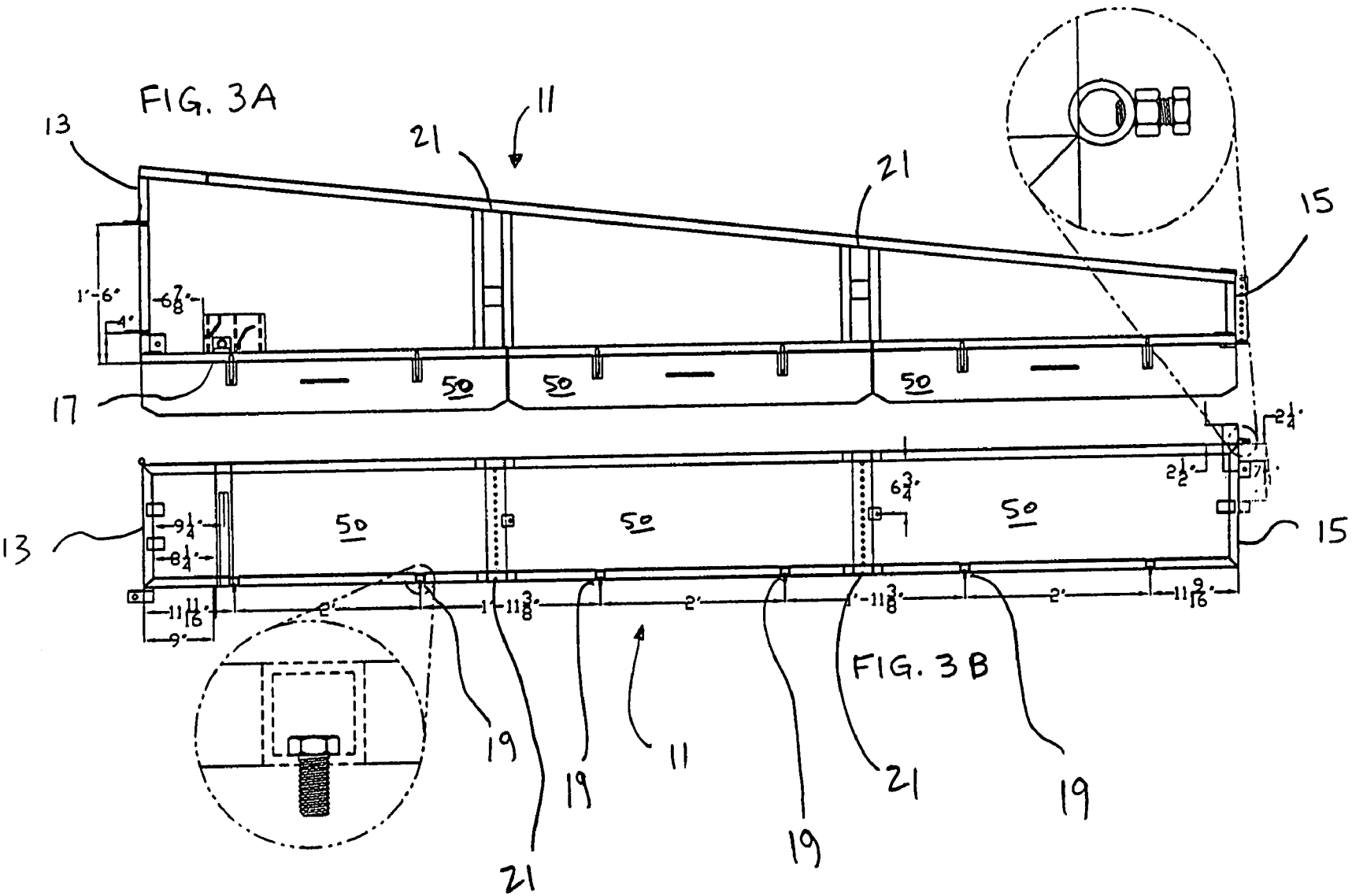
FIG. 3A depicts a front-side elevation of the right-side sub-frame; the left-side sub-frame is a mirror image thereof.
FIG. 3B depicts a top plan view of the sub-frame shown in FIG. 3A.

FIG. 3A depicts a front-side elevation of the right-side sub-frame 11 (the left-side sub-frame is a mirror image thereof). FIG. 3B depicts a top plan view of the sub-frame 11 shown in FIG. 3A. As shown in FIGS. 3A and 3B, each sub-frame 11, includes a first end 13 and a second end 15. Main wheel assembly mounting bracket 17 is shown in FIG. 3A, proximate to the first end of the sub-frame.(FIG. 3A). The mounting bracket is for fixing the main wheel assembly 12 to each sub-frame. Mounting hardware 19 is used to mount the heater housing(s) 50 to each sub-frame. Guide wheel assemblies, if they are present, are mounted at either or both of the mounting posts 21.

Figure 4:
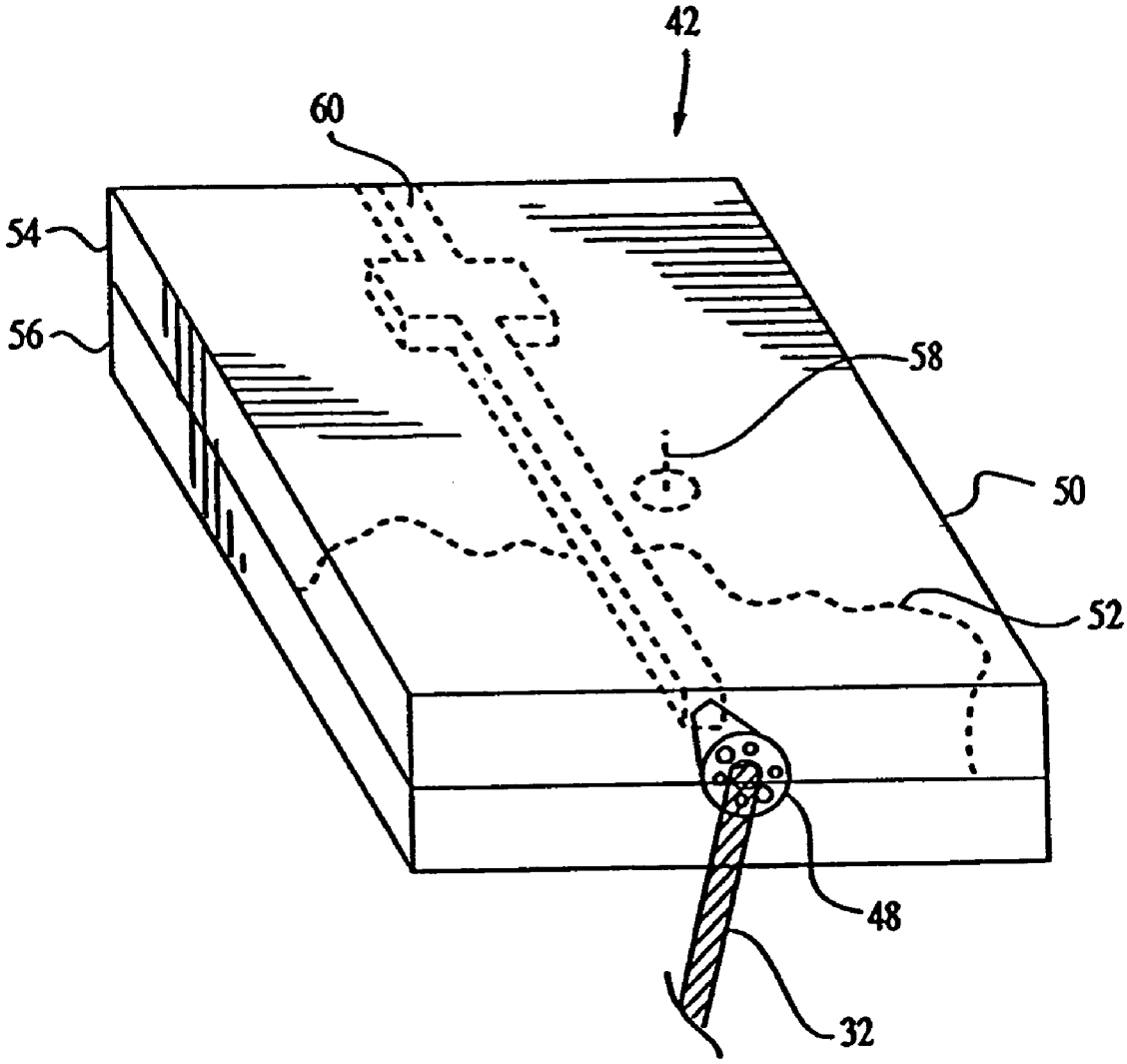
FIG. 4 is a schematic rendering, partially cut-away, of the preferred asphalt heater for use in the present invention.

Each half the frame is dimensioned and configured to support an asphalt heater. Referring now to FIG. 4, the asphalt heater 42 includes a housing 50 which is divided horizontally into an upper chamber 54 and a lower chamber 56 by a sheet or board of gas-permeable refractory material 52. The lower end of the lower chamber 56 is open to the environment.

A combustible fuel-air mixture is introduced into the upper chamber of the asphalt heater by way of fuel line 32. Combustible fuel, stored in fuel tank 30 (see FIG. 1), is passed through a venturi 48 under pressure, whereby the air and fuel are turbulently mixed to yield a combustible fuel-air mixture. As shown in FIG. 4, the venturi enters the upper chamber through a side wall of the housing 50. The venturi can also be positioned to enter the upper from the top wall of the housing. The fuel-air mixture then passes into a manifold 60 which is disposed within the upper chamber of the asphalt heater. Optionally, as the fuel-air mixture enters the manifold, a small amount of the mixture may be directed to a pilot light 62 via pilot light fuel line 32*a* (see FIG. 5, described below). In the absence of the fuel line 32*a*, the mixture is simply introduced into the upper chamber via line 32. The main portion of the fuel-air mixture exits the manifold at outlets 61 and fills the upper chamber 54 of the asphalt heater.

It is preferred that the pressure within the upper chamber of the asphalt heater remain relatively low, on the order of 2.54 to 12.7 kgs per $m^2$. This allows the device to be operated safely without the need for complicated gas regulator equipment. At that pressure, the combustible fuel-air mixture can pass through the refractory material 52 and into the lower chamber of the heater.

Figure 5:
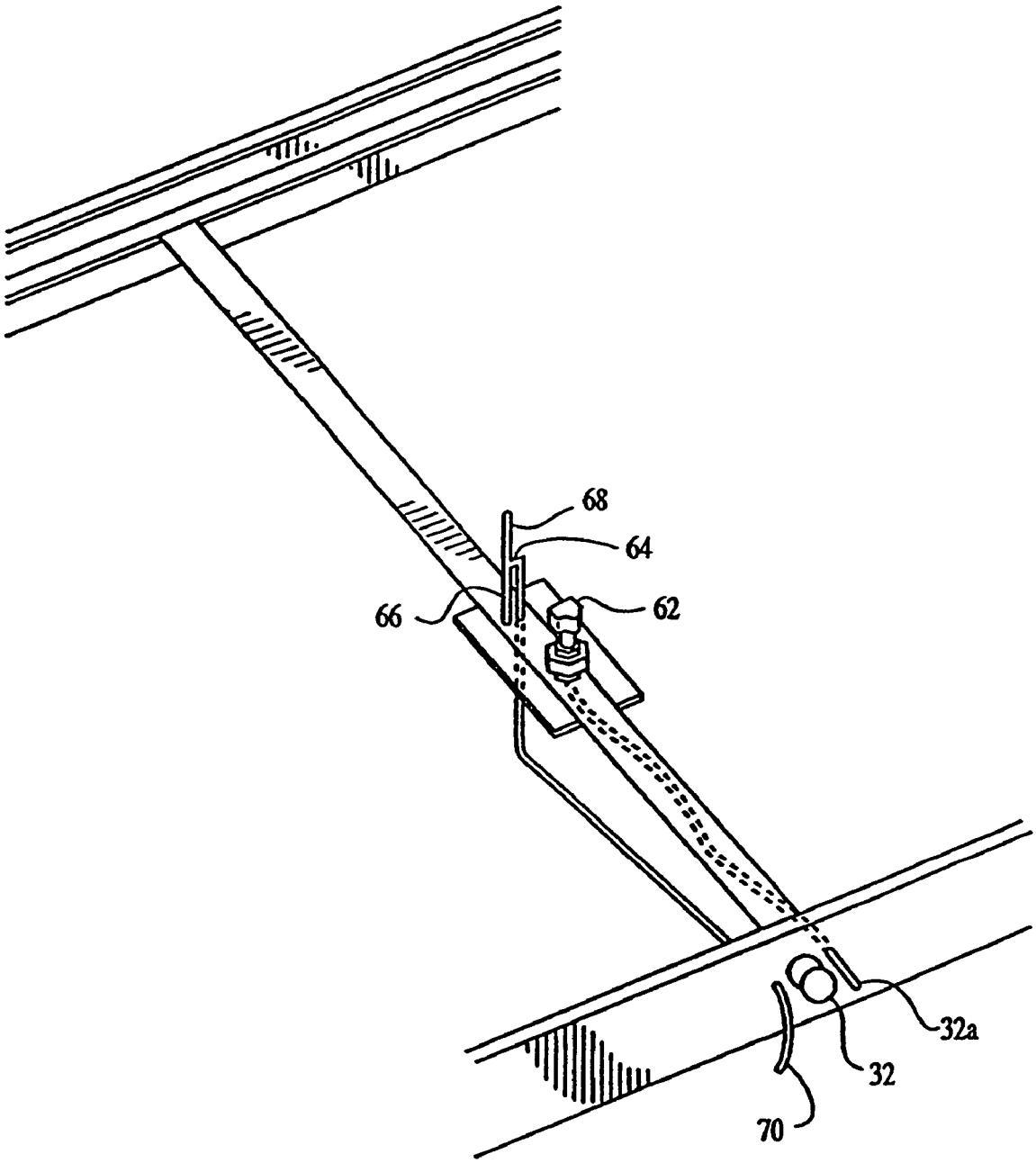
FIG. 5 is a bottom-perspective cutaway rendering of the asphalt heater shown in FIG. 3, and illustrating the ignition sub-assembly. Shown are the main gas supply, pilot light gas supply, flame-sensor, and ignition.

Referring now to FIG. 5, which is an inverted view of the asphalt heater (i.e. through the open lower end of the lower chamber 56), below the refractory material 52 is positioned an ignition sub-assembly which includes a pilot light 62, an igniter having a positive lead 64 and a ground lead 66, an electrical connector 70 to drive the igniter and a flame sensor/thermostat 68. (The refractory 52 is not depicted for purpose of clarity in FIG. 5.) The positive lead 64 of the igniter is connected to a suitable electrical source, such as a battery (not shown). By supplying sufficient electrical charge to the lead 64, an arc can be formed across the space separating the positive lead 64 and the ground lead 66. The flame sensor/thermostat 68, which is of conventional and well known design, serves to indicate whether a flame is present within the lower chamber and indicates/regulates the temperature within the lower chamber.

Figure 6:
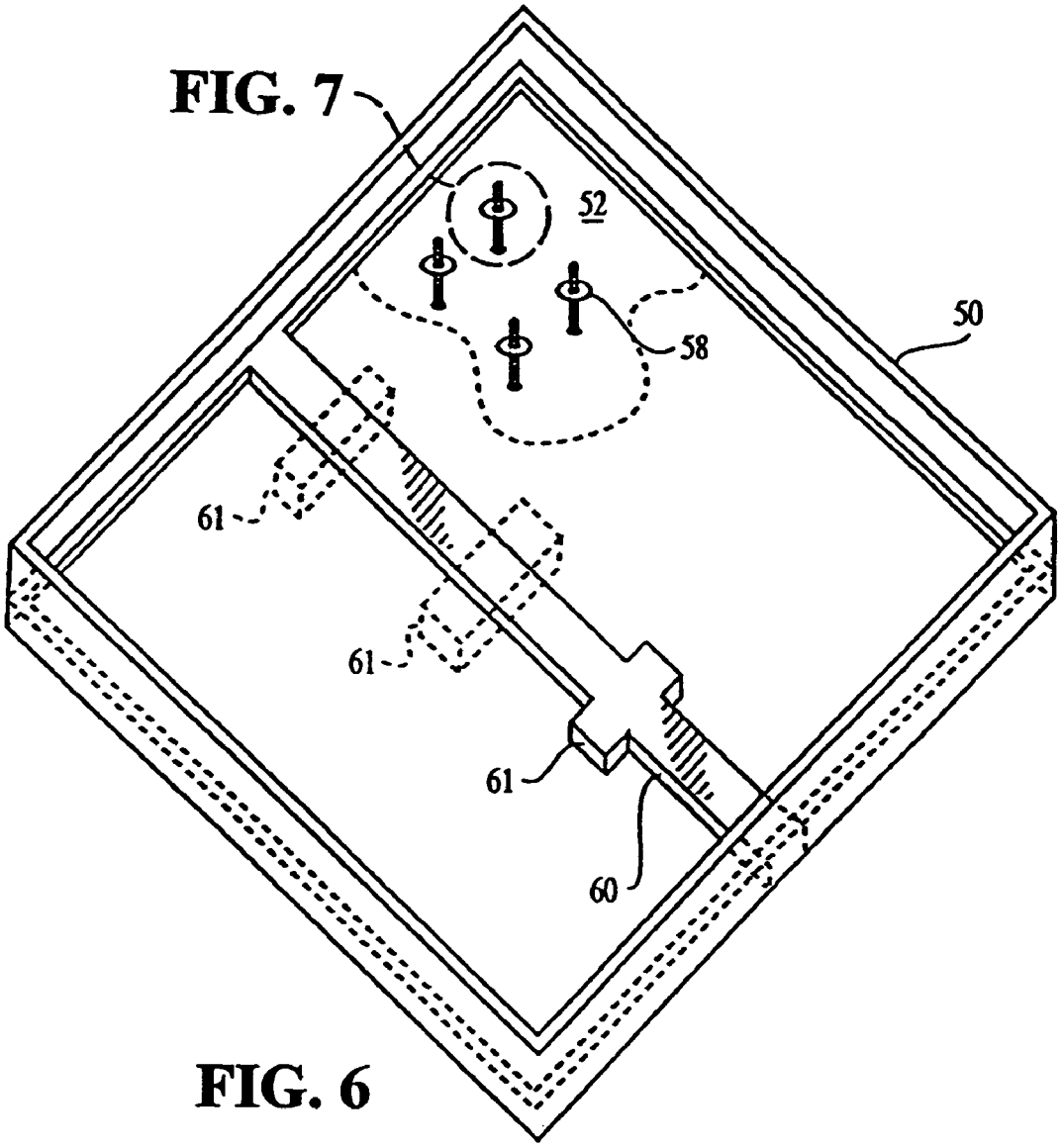
FIG. 6 is a bottom-perspective rendering of the asphalt heater depicted in FIG. 3, with the refractory blanket in place. The ignition sub-assembly has been omitted for clarity.
Figure 7:
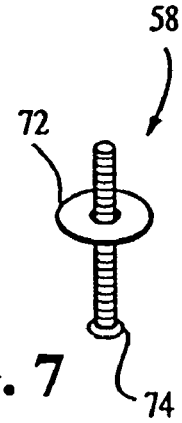
FIG. 7 is a perspective rendering of a fastener 58 as depicted in FIG. 5.

FIG. 6 is a depiction of the asphalt heater from the same direction as in FIG. 5, with the ignition sub-assembly removed and the refractory material partially removed. This view depicts the preferred means by which the refractory material 52 is suspended within the housing. Descending from the top side of the housing are a plurality of fasteners 58, one of which is depicted in isolation in FIG. 7. Each fastener comprises a bolt 74 and a washer 72 attached to the bolt. The bolts extend from the top of the housing through the refractory material and protrude from the lower surface of the refractory material. The washers 72 are then attached to the bolts from the direction of the lower, open end of the lower chamber of the housing. In this fashion, the refractory material 52 rests upon a plurality of washers which are anchored to the top surface of the housing by way of the bolts 74.

In practice, the heater is operated by first opening the fuel supply tank 30 which supplies fuel under a pressure of about 2.54 to 12.7 kgs per $m^2$ to the fuel supply line 32. The fuel then passes through the venturi 48 where the fuel is mixed with a sufficient amount of air to yield a combustible fuel-air mixture. The mixture then passes into the upper chamber 54 of the housing by way of the manifold 60. When the upper chamber become sufficiently pressurized with the fuel-air mixture, the mixture will begin to diffuse through the refractory material 52 and into the lower chamber 56 of the housing.

At this point, the ignition 64 is activated, which ignites the fuel air mixture in the lower chamber of the housing. After a sufficient amount of time elapses to allow the heater to rise to the desired temperature, the frame-borne heater is maneuvered to the desired location and put to work.

What is claimed is:

1. An asphalt seam heater comprising:

an articulated frame movable between a collapsed position and an extended position;

a main wheel assembly attached to the frame and movable about a vertical axis, between a support position wherein the main wheel assembly supports the frame and enables the asphalt seam heater to be towed behind a towing vehicle when the articulated frame is in the collapsed position, and a retracted position wherein the main wheel assembly does not support the frame;

at least one heater disposed within and supported by the frame, the heater comprising:

a housing having an upper chamber and a lower chamber;

a gas-permeable refractory material disposed in the housing to define a closed upper chamber and an open-ended lower chamber;

a fuel line for introducing a combustible fuel-air mixture in to the upper chamber;

a venturi disposed between the fuel line and the upper chamber; and an igniter disposed in the lower chamber, wherein fuel introduced into the upper chamber diffuses through the gas-permeable refractory material and into the lower chamber, where it is ignited by the igniter.

2. The asphalt seam heater of claim 1, further comprising a guide wheel assembly attached to the frame and movable between a retracted position wherein the guide wheel assembly does not support the frame, and an extended position wherein the guide wheel assembly supports the frame.

3. The asphalt seam heater of claim 1, further comprising a trailer tongue attached to the frame, the trailer tongue dimensioned and configured to attach the frame to a towing vehicle when the frame is in the collapsed position.

4. The asphalt seam heater according to claim 1, further comprising a manifold disposed within the upper chamber of the heater and operationally connected to the venturi.

5. The asphalt seam heater of claim 1, wherein the articulated frame comprises two sub-frames, each sub-frame being a mirror image of the other and comprising a first end and a second end, and wherein the two sub-frames are pivotally connected at their respective first ends.

6. The asphalt seam heater of claim 5, wherein each sub-frame includes a corresponding main wheel assembly attached to it at a point proximate to the first end of each sub-frame.

7. The asphalt seam heater of claim 6, wherein each sub-frame includes a corresponding guide wheel assembly attached to it at a point proximate to the second end of each sub-frame.

8. The asphalt seam heater according to claim 7, further comprising a manifold disposed within the upper chamber of the heater and operationally connected to the venturi.

9. An asphalt seam heater comprising:

an articulated frame movable between a collapsed position and an extended position, the frame comprising two sub-frames, each sub-frame being a mirror image of the other and comprising a first end and a second end, and wherein the two sub-frames are pivotally connected about a vertical axis, at their respective first ends;

a main wheel assembly attached to each sub-frame at a point proximate to the first end of each sub-frame, each main wheel assembly movable between a support position wherein the main wheel assembly supports its respective sub-frame and enables the asphalt seam heater to be towed behind a towing vehicle when the articulated frame is in the collapsed position, and a retracted position wherein the main wheel assembly does not support its respective sub-frame;

at least one heater disposed within and supported by one of the sub-frames, the heater comprising:

a housing having an upper chamber and a lower chamber;

a gas-permeable refractory material disposed in the housing to define a closed upper chamber and an open-ended lower chamber;

a fuel line for introducing a combustible fuel-air mixture in to the upper chamber;

a venturi disposed between the fuel line and the upper chamber; and an igniter disposed in the lower chamber, wherein fuel introduced into the upper chamber diffuses through the gas-permeable refractory material and into the lower chamber, where it is ignited by the igniter.

10. The asphalt seam heater of claim 9, wherein each sub-frame includes a corresponding guide wheel assembly attached to it at a point proximate to the second end of each sub-frame, each guide wheel assembly movable between a retracted position wherein the guide wheel assembly does not support its respective sub-frame, and an extended position wherein the guide wheel assembly supports its respective sub-frame.

11. The asphalt seam heater according to claim 9, further comprising a manifold disposed within the upper chamber of the heater and operationally connected to the venturi.

12. The asphalt seam heater of claim 9, further comprising a trailer tongue attached to the frame, the trailer tongue dimensioned and configured to attach the frame to a towing vehicle when the frame is in the collapsed position.

13. An asphalt seam heater comprising:

an articulated frame movable between a collapsed position and an extended position, the frame comprising two sub-frames, each sub-frame being a mirror image of the other and comprising a first end and a second end, and wherein the two sub-frames are horizontally pivotable about their respective first ends;

a main wheel assembly attached to each sub-frame at a point proximate to the first end of each sub-frame, each main wheel assembly movable between a support position wherein the main wheel assembly supports its respective sub-frame and enables the asphalt seam heater to be towed behind a towing vehicle when the articulated frame is in the collapsed position, and a retracted position wherein the main wheel assembly does not support its respective sub-frame;

a guide wheel assembly attached to each sub-frame at a point proximate to the second end of each sub-frame, each guide wheel assembly movable between a retracted position wherein the guide wheel assembly does not support its respective sub-frame, and an extended position wherein the guide wheel assembly supports its respective sub-frame;

at least one heater disposed within and supported by one of the sub-frames, the heater comprising:

a housing having an upper chamber and a lower chamber;

a gas-permeable refractory material disposed in the housing to define a closed upper chamber and an open-ended lower chamber;

a fuel line for introducing a combustible fuel-air mixture in to the upper chamber;

a venturi disposed between the fuel line and the upper chamber;

a manifold disposed within the upper chamber of the heater and operationally connected to the venturi; and an igniter disposed in the lower chamber, wherein fuel introduced into the upper chamber diffuses through the gas-permeable refractory material and into the lower chamber, where it is ignited by the igniter.

14. The asphalt seam heater of claim 13, further comprising a trailer tongue attached to the frame, the trailer tongue dimensioned and configured to attach the frame to a towing vehicle when the frame is in the collapsed position.

* * * * *